US011453022B2

(12) United States Patent
Jouan

(10) Patent No.: US 11,453,022 B2
(45) Date of Patent: Sep. 27, 2022

(54) CONTAINER FOR FLUID PRODUCT

(71) Applicant: POCHET, Clichy (FR)

(72) Inventor: Frédéric Jouan, Moriers (FR)

(73) Assignee: POCHET, Clichy (FR)

( * ) Notice: Subject to any disclaimer, the term of this patent is extended or adjusted under 35 U.S.C. 154(b) by 9 days.

(21) Appl. No.: 16/980,994

(22) PCT Filed: Mar. 14, 2019

(86) PCT No.: PCT/FR2019/050568
§ 371 (c)(1),
(2) Date: Sep. 15, 2020

(87) PCT Pub. No.: WO2019/175513
PCT Pub. Date: Sep. 19, 2019

(65) Prior Publication Data

US 2020/0406280 A1 Dec. 31, 2020

(30) Foreign Application Priority Data

Mar. 16, 2018 (FR) ..... 18 52274

(51) Int. Cl.
*B05B 11/00* (2006.01)
*A45D 34/04* (2006.01)

(52) U.S. Cl.
CPC ..... *B05B 11/3047* (2013.01); *B05B 11/0013* (2013.01); *A45D 34/04* (2013.01); *A45D 2200/054* (2013.01); *B05B 11/3049* (2013.01)

(58) Field of Classification Search
CPC ..... B05B 11/3047; B05B 11/0013; B05B 11/3049; A45D 34/04; A45D 2200/054
See application file for complete search history.

(56) References Cited

U.S. PATENT DOCUMENTS 6,415,962 B1 * 7/2002 Bougamont ..... B05B 11/00412 222/321.7
6,527,149 B1 * 3/2003 Garcia ..... B05B 11/0013 222/321.9

(Continued)

FOREIGN PATENT DOCUMENTS

FR 2 792 295 10/2000
FR 2 845 357 4/2004

(Continued)

OTHER PUBLICATIONS

International Search Report for PCT/FR2019/050568, dated Jun. 5, 2019, 5 pages.

(Continued)

*Primary Examiner* — Jeremy Carroll
(74) *Attorney, Agent, or Firm* — Nixon & Vanderhye

(57) ABSTRACT

A container for fluid product comprises a single glass part. The single glass part comprises a shoulder and a neck which define an internal channel. The container for fluid product comprises a closure member tightly mounted in the internal channel. The closure member is suitable for carrying a dispensing member capable of dispensing content from the container for fluid product to outside the container for fluid product through the closure member. The closure member further comprises at least one sealing lip suitable for forming a sealing area between the neck and the closure member.

19 Claims, 3 Drawing Sheets

(56) References Cited

U.S. PATENT DOCUMENTS

| | | | | |
|---|---|---|---|---|
| 2004/0094551 | A1* | 5/2004 | Mavin | B29C 65/5057 220/258.2 |
| 2006/0081655 | A1* | 4/2006 | Beranger | B05B 11/3049 222/321.9 |
| 2010/0243678 | A1* | 9/2010 | Cornet | B05B 11/3049 222/321.1 |
| 2012/0205401 | A1* | 8/2012 | Litten | B05B 11/3052 222/252 |
| 2015/0144663 | A1* | 5/2015 | Noel | B05B 11/3047 222/383.1 |
| 2016/0175864 | A1* | 6/2016 | Bloc | B05B 11/3047 222/173 |
| 2017/0028421 | A1 | 2/2017 | Martines | |
| 2017/0246649 | A1* | 8/2017 | Elmeguenni | B05B 11/0008 |
| 2018/0014623 | A1 | 1/2018 | Martines et al. | |
| 2018/0022530 | A1* | 1/2018 | Dupont | B05B 11/0013 221/303 |

FOREIGN PATENT DOCUMENTS

| | | |
|---|---|---|
| FR | 3 019 528 | 10/2015 |
| FR | 3 032 187 | 8/2016 |
| FR | 3 032 436 A1 | 8/2016 |

OTHER PUBLICATIONS

Written Opinion of the ISA for PCT/FR2019/050568, dated Jun. 5, 2019, 5 pages.

* cited by examiner

CONTAINER FOR FLUID PRODUCT

This application is the U.S. national phase of International Application No. PCT/FR2019/050568 filed 14 Mar. 2019, which designated the U.S. and claims priority to FR Patent Application No. 18 52274 filed 16 Mar. 2018, the entire contents of each of which are hereby incorporated by reference.

BACKGROUND OF THE INVENTION

Field of the Invention

The present invention relates to a container for fluid product. More particularly, it relates to a container for fluid product onto which a dispensing member is assembled in a sealed manner.

Description of the Related Art

In the field of packaging, in particular in the cosmetics or perfume industry, the aesthetics of packaging hold a particularly important place. Traditionally, the bottles are implemented by a blow-molding process, which allows defining a glass container with a narrow neck onto which a dispensing member is assembled in a sealed manner. As the neck is narrow, it is easy to oversize the sealing solution and thus ensure a sufficiently sealed result for the desired application.

For example, there is the known document FR2845357 which describes a glass bottle for which the sealing function is ensured by the complementary shape between the glass of the bottle and a mounted plastic attachment device into which the dispensing device is inserted, the sealing function being further reinforced by application of an adhesive between the plastic and the glass.

Recently, attempts have been made to break away from the traditional shapes of glass containers having a narrow neck, in favor of glass containers with a wide opening. Such a shape allows accentuating the aesthetics of perfume bottles by allowing an internal engraving or decoration of the bottle. However, such wide openings in glass have significant manufacturing tolerances, making it difficult to seal and close glass containers having a wide opening.

The known document FR3032187 proposes creating a glass bottle by pressing, then attaching a lid having integrated dispensing means. The bottle is sealed by means of gluing between the lid and the bottle. However, this solution does not allow producing a bottle as one piece having a neck with a wide opening. Indeed, glass pressing does not allow the container to have a tubular neck for receiving a dispensing member. Furthermore, it is imperative that the adhesive used be compatible with the product contained, as the product may come into contact with the adhesive positioned on the upper edges of the bottle.

Also known is document FR3032436, which describes a container for fluid product comprising a single glass part with a wide opening. The container comprises a hoop, inserted into the neck of the glass part and suitable for receiving a fluid product dispensing system. A gasket is provided in the neck of the glass part, in order to form a sealing area between the neck and the hoop. More specifically, the gasket is held tightly between the neck and the hoop. In addition, the hoop is held to the glass part by gluing. However, during forcible insertion of the hoop and gasket into the neck of the glass part, the friction of the gasket against the glass of the glass part causes the gasket to roll onto itself. This movement stores energy which is transmitted, at the end of insertion, as a vertical force to the hoop. Thus, to enable effective bonding between the glass part and the hoop, the vertical force must be contained. An additional retaining part is provided in particular for retaining the hoop against the glass part while the adhesive is drying.

BRIEF SUMMARY OF THE INVENTION

The present invention improves the situation.

To this end, it proposes a container for fluid product, comprising

- a single glass part comprising a shoulder and a neck defining an internal channel,
- a closure member tightly mounted in the internal channel and suitable for carrying a dispensing member capable of dispensing content from the container for fluid product to outside the container for fluid product through the closure member, characterized in that

- the closure member further comprises at least one sealing lip suitable for forming a sealing area between the neck and the closure member.

The use of a sealing lip makes it possible to form a sealing area between the fluid product and the exterior of the container. The sealing lip also makes it possible to solve the problem of friction between a gasket and the glass part during insertion of the closure member. The sealing lip also makes it possible to retain the closure member within the neck of the container for fluid product.

According to one embodiment, a gluing between the single glass part and the closure member is provided.

The gluing thus makes it possible to improve the retention of the closure member and dispensing member in the neck of the container. The sealing lip makes it possible to form a sealing area between the gluing and the fluid product contained in the container. It is thus possible to avoid potential contamination of the perfume by the adhesive.

According to one embodiment, an upper end of the closure member is clipped onto an upper end of the neck.

Retention of the closure member on the neck of the container is thus optimized.

According to one embodiment, the closure member comprises a sleeve, the sealing lip extending radially from an outer surface of the sleeve.

In this manner, the sealing lip exerts a radial pressure towards the neck of the single glass part, retaining the closure member in the internal channel.

According to one embodiment, the container further comprises a seal capable of forcing the sealing lip against the neck (4) of the container (1), the seal being positioned between the sealing lip and a sleeve of the closure member.

The seal thus makes it possible to increase the radial pressure exerted towards the neck of the single glass part, in order to increase the retention of the closure member in the internal channel. The seal also makes it possible to form an additional sealing area between the closure member and the neck of the single glass part.

According to one embodiment, the neck defines an opening of the single glass part, said opening being a wide opening, in particular with a diameter of more than 21 millimeters.

The wide opening allows strengthening the aesthetics of the container, and/or inserting tools to create an interior decoration.

According to one embodiment, the internal channel has an inner shoulder defining the application area for the gluing between the neck and the closure member.

The gluing area thus is not located directly at the neck of the single glass part. The risk of the gluing coming into contact with the fluid product contained in the container is reduced.

According to one embodiment, the application area of the gluing is accessible from outside the container for fluid product.

The assembly of the container for fluid product is thus facilitated.

According to one embodiment, the closure member comprises a bead, said bead coming to bear on the inner shoulder of the internal channel.

This embodiment makes it possible to increase the area of contact at the gluing between the closure member and the single glass part. The gluing area can thus be significant, and ensure a secure attachment between the closure member and the single glass part.

According to one embodiment, the closure member comprises a central passage intended for receiving and retaining a dispensing member.

A single part is thus used to attach the dispensing member as well as to plug the opening of the single glass part.

According to one embodiment, the closure member comprises an inner skirt. A dispensing member is clipped onto the inner skirt.

According to one embodiment, a dispensing member is screwed onto the inner skirt.

According to one embodiment, the inner skirt has an outer diameter, at an attachment area for the dispensing member, defined by an outer face, chosen from 13 mm, 15 mm, 17 mm, 18 mm, or even 11 mm or 20 mm.

The inner skirt is thus suitable for receiving any type of dispensing member generally available on the market. The dimensions of the diameter of the inner skirt correspond to the conventional dimensions of clip-on or screw-on dispensing members.

According to one embodiment, the inner skirt extends parallel to the neck, from the sleeve.

According to one embodiment, an upper end of the inner skirt extends radially towards a central axis of the single glass part.

This particular configuration makes it possible to optimize the attachment of the dispensing member to the closure member. The upper end of the inner skirt serves as a stop along an axis at the dispensing member.

According to one embodiment, the seal is an inserted seal. This is a simple solution to implement.

According to one embodiment, the seal is overmolded on the closure member, the complex of closure member and seal being created by bi-injection. This ensures quality.

According to one embodiment, the closure member is made of plastic and/or elastomer. The elastic properties of such a material make it possible to compensate for certain gaps and tolerances and to give the sealing lip a resilience which exerts a clamping force relative to the internal channel.

According to one embodiment, the dispensing member comprises a chamber and a pushbutton, the chamber being able to deliver a predetermined amount of fluid product in response to a pressing action on the pushbutton.

BRIEF DESCRIPTION OF THE DRAWINGS

Other features and advantages of the invention will be apparent from the description given below, with reference to the drawings in which.

DETAILED DESCRIPTION OF THE PREFERRED EMBODIMENTS

Below is a detailed description of several embodiments of the invention, accompanied by examples and references to the drawings.

Figure 1:
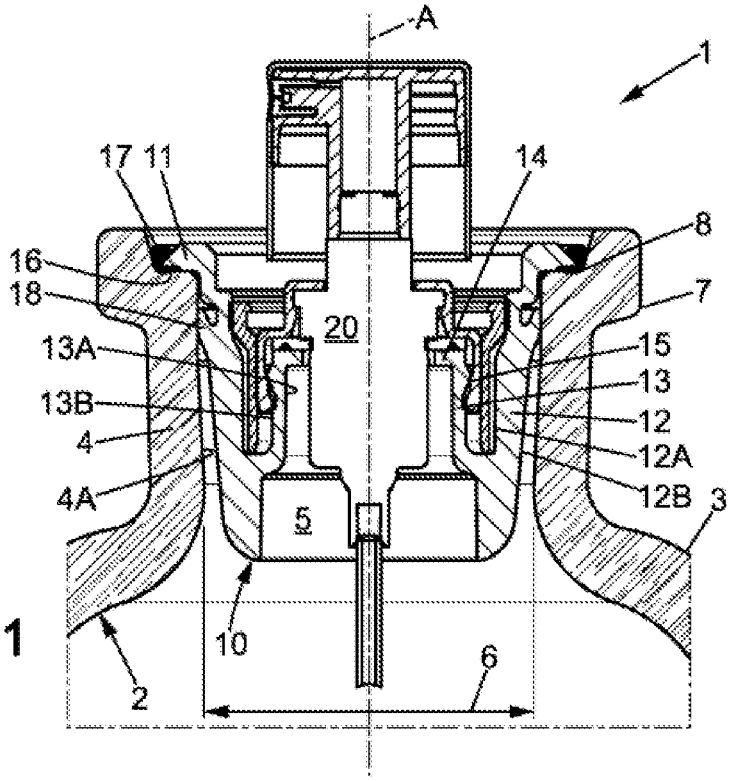
FIG. 1 is a schematic sectional view of the container for fluid product according to a first embodiment of the invention.

Reference is made to FIG. 1, in which an example of a container for fluid product according to a first embodiment of the invention is illustrated. The container for fluid product 1 comprises a single glass part 2 suitable for receiving the fluid product. The container for fluid product 1 is described in its natural position of use, in which it rests with its bottom portion on a flat horizontal support. The terms "upper", "lower" in the detailed description are given in reference to this orientation. A central axis A of the container 1 may be defined.

The single glass part 2 is of substantially cylindrical shape. The lower portion of the single glass part 2 is for example defined by the bottom portion of the container and a shoulder 3. The lower portion of the single glass part 2 serves as a container for the fluid product.

The upper portion of the single glass part 2 is defined by the upper end of the single glass part 2 and the shoulder 3. The neck 4 is located at the upper portion of the single glass part. The neck 4 may have a narrower diameter than the diameter of the lower portion of the single glass part 2. The interior of the single glass part 2 defines the internal channel 5. The single glass part 2 is for example made by blow-molding.

Figure 2:
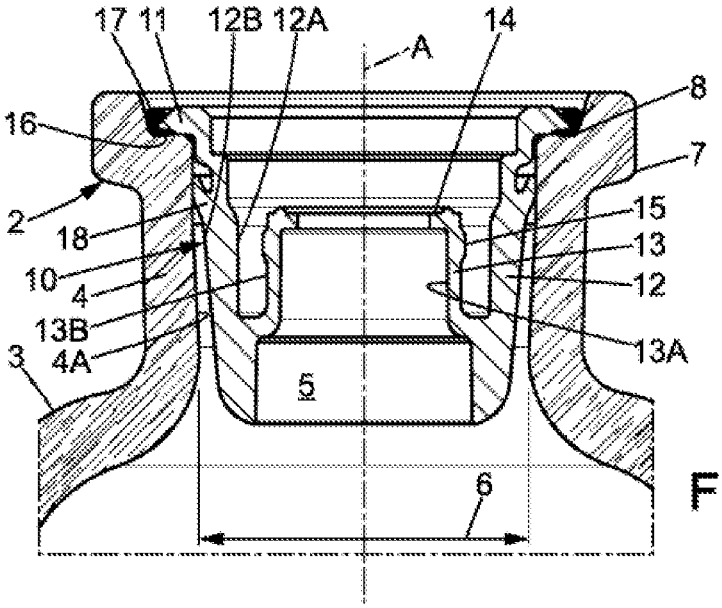
FIG. 2 is a cross-section of the assembly formed of the single glass part and closure member according to a first embodiment of the invention.
Figure 3:
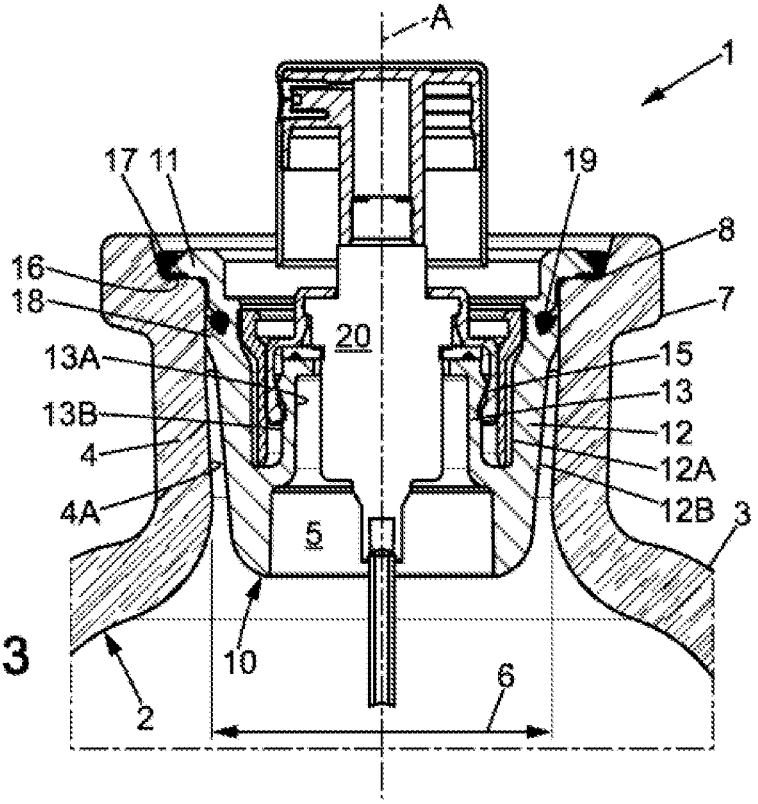
FIG. 3 is a schematic sectional view of the container for fluid product according to a second embodiment of the invention.

As can be seen in FIGS. 1 to 3, the neck 4 of the single glass part 2 defines an opening 6 of the single glass part 2. The opening 6 is preferably circular, without excluding an elliptical or oval shape, however.

The opening 6 may be a wide opening compared to the so-called "conventional" openings of the prior art. The diameter of the wide opening 6 defined by the neck 4 is for example greater than 15 millimeters (mm). Preferably, the diameter of the opening 6 is greater than 18 mm Preferably, the diameter of the opening 6 is greater than 20 mm. In a preferred embodiment, the diameter of the opening 6 is greater than 21 mm. The wide opening 6 allows in particular the insertion of a tool into the single glass part 2. Such a tool may, for example, be used to decorate the single glass part 2 from the inside.

The neck 4 of the single glass part 2 may have a radial outward protuberance 7 at its upper end. The diameter of the upper portion of the single glass part 2 at the protuberance 7 is therefore larger than the diameter of the neck 4. The protuberance 7 in particular can facilitate the handling of the container for fluid product 1, by a tool or user.

The neck 4 of the single glass part 2 may also have an inner shoulder 8. The inner shoulder 8 may define a recess of the neck 4. The inner shoulder 8 is located for example at the upper end of the neck 4. More precisely, the inner shoulder 8 may be located at the protuberance 7. According to one exemplary embodiment, the inner shoulder 8 extends from the internal channel 5, over part of the length of the protuberance 7.

Figure 4:
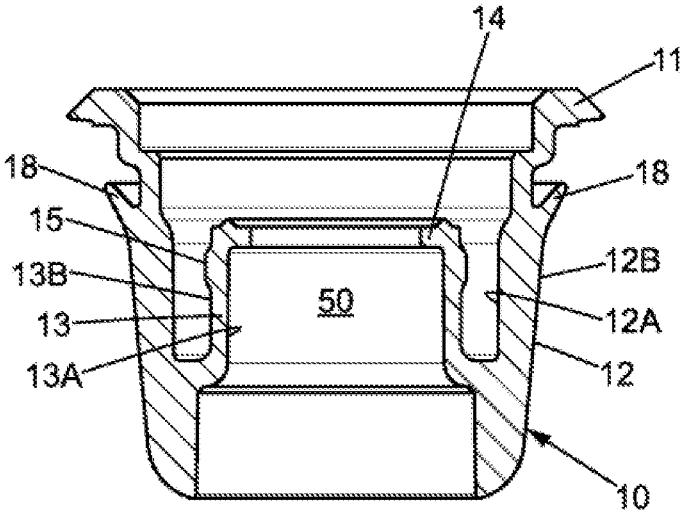
FIG. 4 is a cross-section of the closure member according to an exemplary embodiment of the invention.

As can be seen in FIGS. 1 and 4, the container 1 comprises for example a closure member 10 ensuring in particular the sealing of the container for fluid product 1. The closure member 10 comprises a central passage 50. The central passage 50 of the closure member 10 is suitable for receiving a dispensing member 20 capable of dispensing content from the container for fluid product 1 to outside the container. The dispensing member 20 may for example comprise a pump. More specifically, the dispensing member 20 comprises a chamber 21 and a pushbutton 22, which are known per se and therefore are not detailed here.

More particularly, according to one embodiment, the closure member 10 may have a generally frustoconical cross-section. The upper portion of the closure member 10 is slightly wider than the lower portion of the closure member 10. The closure member 10 may have a bead 11 at its upper end. The bead 11 extends radially in the direction away from the central axis A of the container 1. The bead has a length suitable for bearing directly against the inner shoulder 8 of the neck 4 when the closure member 10 is mounted on the single glass part 2. Advantageously, the bead 11 may have a length/dimension slightly less than the length/dimension of the inner shoulder 8 of the neck 4, as can be seen in FIGS. 1 to 3.

The closure member 10 may have a sleeve 12 and an inner skirt 13. The inner skirt 13 extends from the sleeve 12 of the closure member 10. The sleeve 12 comprises in particular an inner face 12A and an outer face 12B. The inner skirt 13 comprises in particular an inner face 13A and an outer face 13B. The outer face 13B of the inner skirt 13 faces the inner face 12A of the sleeve 12 of the closure member 10. The inner face 13A of the inner skirt 13 faces the dispensing member 20, as can be seen in FIGS. 1 and 3. The inner skirt 13 may extend substantially parallel to the sleeve 12 of the closure member 10. Advantageously, the inner skirt 13 does not extend for the entire length of the sleeve 12 of the closure member 10 but over only a portion of the length of the sleeve 12.

An upper end 14 of the inner skirt 13 may extend radially for a few millimeters in the direction of the central axis A of the container 1. The shape of the upper end 14 of the inner skirt 13 can serve as a stop along the central axis A of the dispensing member 20.

The outer face 13B of the inner skirt 13 may have an attachment area 15 for the dispensing member 20. For example, the attachment area 15 comprises a protuberance. The protuberance may be used for clipping the dispensing member 20 on the closure member 10. Alternatively, the attachment area 15 comprises helical grooves suitable for screwing in the dispensing member 20.

The diameter of the inner skirt 13 at the attachment area 15, defined by its outer face 13B, may be equal to the diameters of the necks of so-called conventional containers for fluid product, in other words a diameter of about 13 mm. This diameter corresponds to a standard diameter of the dispensing members found on the market. In this non-limiting exemplary embodiment, the diameter is exactly 13 mm, within the tolerances defined in the standard.

As a variant, the diameter of the inner skirt 13 at the attachment area 15 is for example equal to 15 mm, 17 mm, 18 mm, or even 11 mm and 20 mm. These diameters correspond to standard diameters, as defined in the FEA ("European Aerosol Federation") standard. The dispensing members may be pumps that can be screwed or clipped on the closing device.

In one exemplary embodiment, illustrated in FIGS. 1 to 3, the inner shoulder 8 of the neck 4 serves as an application area 16 for a gluing 17 between the closure member 10 and the single glass part 2. The gluing 17 may be applied directly on the inner shoulder 8 of the neck 4. When the container is assembled, the gluing 17 may be directly accessible from outside the container due to the slight difference between the length of the inner shoulder 8 and the length of the bead 11. Due to this accessibility, the gluing 17 is compatible with the fluid product. Indeed, during dispensing of the fluid product by the dispensing member 20, microdroplets may fall onto the gluing 17. The gluing 17 may be a two-component adhesive.

The two-component adhesive makes it possible to meet the compatibility requirements imposed by the fluid product, in other words the fluid product does not damage the adhesive and vice versa. Moreover, the two-component adhesive does not release compounds liable to mix with the fluid product. The adhesive may also be a silicone adhesive.

The closure member 10 may also be fixed to the single glass part 2 by means of a sealing lip 18. As is more particularly illustrated in FIG. 4, the sealing lip 18 extends for example substantially radially from the outer face 12B of the sleeve 12 of the closure member 10. The sealing lip 18 extends for example for a few millimeters. The sealing lip 18 is, for example, made of an elastic and substantially deformable material. The sealing lip 18 is, for example, integrally formed with the closure member 10.

The closure member 10 is made of plastic material and/or of elastomer material. The elastic properties of this material make it possible to compensate for certain gaps and tolerances of the internal channel 5. The elastic properties of this material allow giving the sealing lip 18 a resilience which exerts a clamping force against the internal channel and helps to form a tight seat at that location.

In the exemplary embodiment illustrated in the figures, the closure member 10 comprises a single sealing lip 18. According to an alternative embodiment, the closure member 10 may comprise more than one sealing lip 18. For example, the closure member 10 comprises two sealing lips 18, preferably three sealing lips 18, or even four sealing lips 18.

Alternatively, the sealing lip 18 is overmolded on the outer face 12B of the sleeve 12. The system of overmolded sealing lip 18 and closure member 10 is produced by bi-injection. The material constituting the sealing lip 18 is heated and injected directly onto the outer face 12B of the sleeve 12. This method allows joining the two different materials constituting the sealing lip 18 and the closure member 10, while optimizing the time required to create these two parts.

The sealing lip makes it possible in particular to form a sealing area between the neck 4 of the glass part 2 and the closure member 10. In this manner, the gluing 17 and the fluid product cannot come into contact with each other. Similarly, the fluid product cannot escape from the container for fluid product 1 via the edges of the internal channel 5.

In addition, the sealing lip 18 provides mechanical strength between the single glass part 2 and the closure member 10. The closure member 10 carrying the sealing lip 18 is tightly mounted in the internal channel 5. To allow insertion of the closure member 10 into the internal channel 5, the sealing lip 18 deforms, as shown in FIGS. 1 and 2. The sealing lip 18, which wants to return to its original shape, exerts radial pressure against the neck 4 of the single glass part 2. The radial pressure presses the closure member 10 against the single glass part 2, and thus prevents movement of the closure member 10 and single glass part 2 relative to one another. This makes it possible to form the sealing area between the neck 4 of the glass part 2 and the closure member 10.

According to an alternative embodiment illustrated in FIG. 3, a seal 19 is further provided. The seal 19 is, for example, arranged between the outer face 12B of the sleeve 12 and the sealing lip 18. The seal 19 is, for example, made of an elastic and substantially deformable material. To enable insertion of the closure member 10 into the internal channel 5, the sealing lip 18 deforms, causing deformation of the seal 19 which is then compressed against the outer face 12B of the sleeve 12. After insertion of the closure member 10 into the internal channel 5, the seal 19 wants to return to its original shape. The seal 19 then exerts pressure on the sealing lip 18. The pressure of the seal 19 on the sealing lip as well as the radial pressure exerted by the sealing lip 18 against the single glass part allow increasing the sealing between the neck 4 of the glass part 2 and the closure member 10. Moreover, the risk of movement of the closure member 10 and single glass part 2 relative to one another is reduced.

During insertion of the closure member 10 into the internal channel 5, the sealing lip 18 prevents contact of the seal 19 with the single glass part 2. Friction between the seal 19 and the single glass part 2 is thus eliminated. The seal 19, which does not store energy, does not create a vertical force driving the closure member out of the single glass part 2. The gluing between the closure member 10 and the single glass part 2 thus can dry without requiring any parts to retain the closure member 10 in the internal channel 5.

According to one variant, the seal 19 may be overmolded on the closure member 10, between the sealing lip 18 and the outer face 12B of the sleeve 12. The system of overmolded seal 19 and closure member 10 is produced by bi-injection. The material constituting the seal 19 is heated and injected directly between the sealing lip 18 and the sleeve 12. This process will allow joining the two different materials constituting the seal 19 and the closure member 10, while optimizing the time required to create these two parts. According to another variant, the seal 19 and the sealing lip 18 are overmolded onto the closure member 10.

Figure 5:
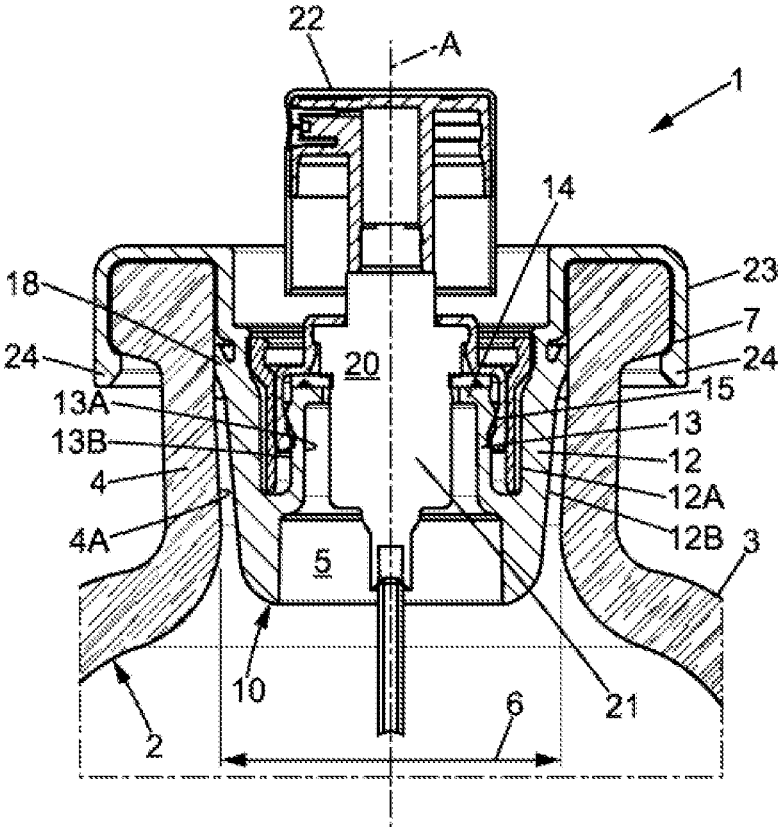
FIG. 5 is a schematic sectional view of the container for fluid product according to a third embodiment of the invention.

In the exemplary embodiment illustrated in FIG. 5, the single glass piece 2 does not have an inner shoulder 8. An upper end of the closure member 10 extends radially in the direction away from the central axis A of the container 1, for a length suitable for bearing directly against the upper end of the neck 4. The closure member 10 may further comprise a return 23, formed as a flat ring with a return. The return 23 comprises a projecting end 24. The end 24 and the protuberance 7 of the neck 4 engage via an elastic snap-fit mechanism. More specifically, the closure member 10 is forcibly inserted around the neck 4 of the glass part 2. The projecting end 24 causes deformation of the return 23 during insertion of the closure member 10 around the neck. 4. After insertion of the closure member 10 on the neck 4, the projecting end 24 is located under the protuberance 7 of the glass part, which allows the return 23 to resume its initial shape. The upper end of the closure member 10 is thus clipped onto the upper end of the neck 4. The projecting end 24 also prevents inadvertent separation of the glass part 2 and closure member 10.

As a variant, the closure member 10 does not comprise a return 23. The upper end of the closure member 10 comes to bear against the upper end of the neck 4.

Firstly, a single glass part as described above is provided, having a wide opening. It is created for example by blow-molding. Also provided is a closure member, as described above, with a sealing lip provided on the closure member. An adhesive tape is applied to the surface of the single glass part, for example at an inner shoulder defined at the upper end of the single glass part.

The closure member is assembled to the glass part. For example, a forced insertion may be carried out by exploiting the deformability of the material constituting the closure member and sealing lip. The sealing lip, compressed between the glass part and the closure member, contributes to maintaining the two parts in their relative position. The two parts are in contact while the adhesive sets sufficiently. The product thus obtained has a central passage 50. This product can be shipped to a third party who can fill it with a cosmetic product through the central passage 50. The central passage 50 is then sealed closed by the assembling of a dispensing system.

In another variant, the closure member comprising the sealing lip is assembled to the glass part. A seal is arranged between the sealing lip and an outer face of the closure member. For example, forced insertion may be carried out by taking advantage of the deformability of the material constituting the closure member, the sealing lip, and the seal. The seal, held between the sealing lip and the outer face of the closure member, compresses the sealing lip against the glass part and the closure member thus contributes to maintaining the two parts in their relative position. The parts are in contact while the adhesive sets sufficiently. The product thus obtained has a central passage 50. This product can be shipped to a third party who can fill it with a cosmetic product through the central passage 50. The central passage 50 is then sealed closed by the assembling of a dispensing system.

Alternatively, the closure member is assembled to the glass part. The upper end of the closure member 10 comprises a return 23 having a projecting end 24. The return 23 is assembled onto the neck of the glass part by a snap-fit mechanism, such that the closure member is clipped onto the glass part.

Of course, the present invention is not limited to the embodiments described above as examples; it extends to other variants.

For example, the cross-section of the opening 6 is not necessarily circular. The opening may retain a high radius of curvature but have a shape that is oval, elliptical, or even polygonal with rounded corners. In this case, the diameter of the largest circle inscribed within the opening defines the diameter of the wide opening 6.

For example, the wide opening 6 may be further widened. In this example, the closure member 10 must also be widened in order to bear against the further widened opening 6. In order to ensure the sealing of the container for fluid product 1 in this embodiment, the sleeve 12 of the closure member 10 may have vertical ribs on its inner face 12A. These vertical ribs will allow the closure member 10 to retain the same inscribed diameter at the inner face 12A of the sleeve 12. In this manner, a range of products constructed according to the same architecture can be defined, comprising different diameters of the outer face 13B of the inner skirt 13 at the attachment area 15, corresponding to different possibilities defined in the standard.

REFERENCES

| | | |
|---|---|---|
| Container for fluid product 1 | Closure member 10 | Application area 16 |
| | Bead 11 | Adhesive 17 |
| Single glass part 2 | Sleeve 12 | Sealing lip 18 |
| Shoulder 3 | Inner face 12A | Seal 19 |
| Neck 4 | Outer face 12B | Dispensing member 20 |
| Inner face of neck 4A | Inner skirt 13 | Chamber 21 |
| Internal channel 5 | Inner face 13A | Pushbutton 22 |
| Opening 6 | Outer face 13B | Return 23 |
| Protuberance 7 | Upper end 14 | Projecting end 24 |
| Inner shoulder 8 | Attachment area 15 | Central passage 50 |

The invention claimed is:

1. A container for fluid product, the container comprising:

a single glass part comprising a shoulder and a neck which define an internal channel; and a closure member tightly mounted in the internal channel and configured to carry a dispensing member configured to dispense content from the container to outside the container through the closure member, the closure member comprising a sleeve that is surrounded by the neck, and a sealing lip configured to form a sealing area between the neck and the closure member, the sealing lip extending radially and upwardly from an outer surface of the sleeve.

2. The container for fluid product according to claim 1, further comprising a gluing between the single glass part and the closure member.

3. The container for fluid product according to claim 1, wherein an upper end of the closure member is clipped onto an upper end of the neck.

4. The container for fluid product according to claim 3, wherein the closure member is a single piece made of one or more of plastic and elastomer, the closure member extending annularly around a central axis of the container, the closure member comprising, outside the neck, an outer portion provided with:

a flat ring extending to cover the upper end of the neck and connected to a top of the sleeve, a deformable return extending downwardly from an outer circumference of the flat ring, around an outer protuberance of the neck, and a projecting end included in the return, at a lower end of the return, the projecting end protruding radially inwards so that the projecting end is engaged below the outer protuberance of the neck, and wherein the projecting end and the sealing lip protrude radially toward the neck.

5. The container for fluid product according to claim 1, further comprising a seal configured to force the sealing lip against the neck of the container, the seal being positioned between the sealing lip and the sleeve of the closure member.

6. The container for fluid product according to claim 5, wherein:

the seal is an inserted seal disposed in an annular outer recess of the sleeve, the outer recess being delimited by a top face of the sealing lip so that the seal extends adjacent to and above the sealing lip.

7. The container for fluid product according to claim 5, wherein the seal is overmolded on the closure member by bi-injection.

8. The container for fluid product according to claim 1, wherein the neck defines an opening of the single glass part, said opening being a wide opening having a diameter of more than 21 mm.

9. The container for fluid product according to claim 1, wherein the closure member comprises a central passage configured to receive and retain the dispensing member, and the sealing lip extends at an axial position, inside the neck, which is above the central passage.

10. The container for fluid product according to claim 9, further comprising a central axis, around which the neck extends annularly from the shoulder to an upper end of the neck which is an uppermost face of the single glass part, wherein the closure member forms a single piece including an inner skirt extending upwardly from an annular junction with a lower end of the sleeve, inside the sleeve, the inner skirt delimiting the central passage.

11. The container for fluid product according to claim 10, wherein the central passage is:

arranged axially below the upper end of the neck for accommodation inside the neck of an enlarged section part of the dispensing member, the central passage having a larger transverse section than a central passage section, and arranged axially below a cavity that opens upwardly by an upper access, the cavity being delimited by the sleeve, and wherein the upper access of the cavity is of larger transverse section as compared with the central passage section, the upper access of the cavity housing said enlarged section part of the dispensing member inside the sleeve.

12. The container for fluid product according to claim 1, wherein the closure member comprises an inner skirt having an outer diameter, at an attachment area for the dispensing member, defined by an outer face, chosen from one of 13 mm, 15 mm, 17 mm, 18 mm, 11 mm, and 20 mm.

13. The container for fluid product according to claim 1, wherein the closure member is a single piece made of one or more of plastic and elastomer.

14. The container for fluid product according to claim 1, wherein the dispensing member comprises a chamber and a pushbutton, the chamber being configured to deliver a predetermined amount of a fluid product in response to a pressing action on the pushbutton.

15. The container for fluid product according to claim 1, wherein the sealing lip surrounds an annular recess of the sleeve, the annular recess opening radially outwards.

16. A container for fluid product, the container comprising:

a single glass part comprising a shoulder and a neck which define an internal channel;

a closure member tightly mounted in the internal channel and configured to carry a dispensing member configured to dispense content from the container to outside the container through the closure member, the closure member being a single piece, the closure member comprising a sealing lip configured to form a sealing area between the neck and the closure member; and a gluing between the single glass part and the closure member, wherein the neck has a neck interior face provided with an inner shoulder defining an application area, entirely inside the neck, for the gluing between the neck and the closure member.

17. The container for fluid product according to claim 16, wherein the closure member entirely extends below an uppermost face of the single glass part, the uppermost face being provided at an upper end of the neck.

18. The container for fluid product according to claim 16, wherein the single piece of the closure member further comprises a sleeve, the sealing lip extending radially outwards from an outer surface of the sleeve.

19. The container for fluid product according to claim 18, wherein the closure member has an upper end at a top of the sleeve, a bead at the upper end extending radially outwards to define an outer shoulder of the closure member axially facing the inner shoulder.

* * * * *